United States Patent [19]

Pavelle et al.

[11] Patent Number: 4,968,395

[45] Date of Patent: Nov. 6, 1990

[54] METHOD AND APPARATUS FOR INCREASING CATALYTIC EFFICIENCY OF ELECTRODES

[76] Inventors: Richard Pavelle, 23 Berkshire Dr., Winchester, Mass 01890; Paul Burstein, 19 Glengarry, Winchester, Mass 01890; Leon Ferber, 2310 Stearns Hill Rd., Waltham, Mass 02154

[21] Appl. No.: 369,370

[22] Filed: Jun. 21, 1989

[51] Int. Cl.[5] ..... C25F 5/00

[52] U.S. Cl. ..... 204/130; 204/140; 204/222

[58] Field of Search ..... 204/130, 140, 222

[56] References Cited

U.S. PATENT DOCUMENTS 3,715,238 2/1973 Mayell ..... 204/130

*Primary Examiner*—T. M. Tufariello

*Attorney, Agent, or Firm*—Sprung, Horn, Kramer & Woods

[57] ABSTRACT

A catalytic process and apparatus has at least one electrode composed of catalytic material. An electric current is applied to the at least one electrode which is mechanically manipulated to increase the operating efficiency thereof during application of the electric current.

26 Claims, 4 Drawing Sheets

METHOD AND APPARATUS FOR INCREASING CATALYTIC EFFICIENCY OF ELECTRODES

BACKGROUND OF THE INVENTION

The present invention relates to the use of electrodes in catalytic processes. The main function of a catalyst is to provide a changed local structure that yields a site for a reaction to occur without the catalyst being used up itself. Catalysis gained prominence shortly after WW II as "catalytic reforming" revolutionized the petroleum industry. The literature abounds with references to catalysis applied to numerous processes.

In certain processes, the catalyst is itself an electrode. Platinum and palladium are the two most common catalytic electrodes. These are used for a wide variety of organic oxidation reactions. Titanium and carbon are also very common; titanium is used for sodium hydroxide-chlorine production; carbon is the standard catalytic electrode for fuel cells. It is to this type of process that the present invention is directed. It is well known that the total surface area and/or volume, occlusive capacity, and the local physical properties of the electrode in such a process partially determine the reaction rates. These factors can be affected drastically by the detailed preparation and maintenance of the electrodes and of the host bath of which the pH may be altered. For example, in certain reactions, milled or extruded electrodes do not function in the same manner as do cast or surface-roughened electrodes made of identical material. This can be caused by impurities that find their way into the catalytic electrode during the casting process. Moreover, the various electrochemical processes involving these catalytic electrodes can also render the electrodes less efficient as the catalytic process continues. In a lead acid battery, one electrode is lead, the other lead oxide. After a number of years in regular use, built-up of contaminants in the lead electrode renders the battery far less efficient than it would otherwise be.

SUMMARY OF THE INVENTION

To this point, those knowledgeable in the field have not attempted to manipulate the catalytic electrodes in order to increase their efficiency. It is the main object of the present invention to provide methods, and apparatus for accomplishing this function, thereby increasing the overall efficiency of these processes with a minimum of manual replacement, overhaul or other method that requires removal for e.g. cleaning of the catalytic electrode from its functional environment.

The purpose of electrode manipulation is to extend or enhance the initial efficiency provided by the catalyst in order to nullify the degrading effects of the process or the catalyst's preparation. This manipulation also affects confinement times and the mobility of the reactants in the lattice and at its surface. For example, it is known that the electrode surface character changes with time, depending upon the process. As an application, so-called "cold fusion" relies on cast rather than milled paladium catalytic electrodes, and the effects of heat and time may render the paladium electrodes less efficient. Moreover, start-up time while now on the order of several days or weeks may be shortened considerably. There are several methods for achieving this end. The most commonly used are chemical, e.g., lithium or other metal salt doping in heavy water to enhance the uptake of neutral or ionic deuterium (or other subatomic particles such as muons) in paladium or titanium by altering the pH of the fluid. The metal salt choices must provide sufficient salt doping for initializing the process without plating the anode, an undesirable effect which could lead to shut-down of the process.

The methods and apparatus described herein are primarily mechanical and electromagnetic in nature. The aim of these methods is break-up of large crystallites of the catalytic lattice into much smaller domains. Keeping the crystallites small appears to enhance the catalytic process.

The mechanical methods include compression, tension and torque, shock, and acoustic wave generation. These can be applied in either static or dynamic (time-varying) mode, as discussed hereinafter. Other methods such as electromagnetic pulses (e.g., plasma arc) and laser activation at surface of the catalytic electrode are also within the scope of the invention.

These and other features and advantages of the present invention will be described in more detail hereinafter with respect to the attached drawings wherein:

DETAILED DESCRIPTION OF THE INVENTION

FIGS. 1–5 show different embodiments of electrodes according to the invention.

Figure 1:
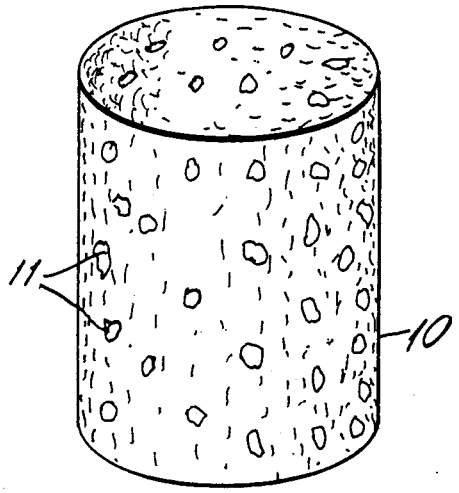
FIGS. 1–5 illustrate different configurations of electrodes in accordance with the invention.
Figure 2:
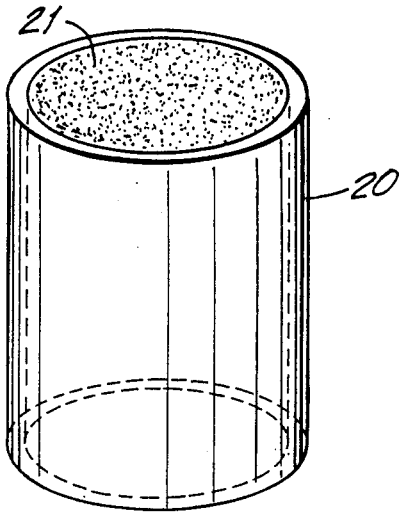

Very often, a catalyst must be run in high temperature environments, for example catalytic converters for automobile and power plant emissions. One method for protecting the catalyst 1 is by its suspension in a ceramic, alloy or carbon-carbon host 10 as shown in FIG. 1, or any similar material with special properties; these properties include good immunity to high temperature and porosity, thus still allowing the flow of reactants to the catalyst. This rigid bonding as shown in FIG. 1 can also maintain the catalyst's molecular/particulate orientation and the local physical properties that might otherwise be disturbed by the chemical process or by the local environment (e.g., temperature, pressure). In this form, an electrode of opposite polarity can be built into the housing of the material leading to a compact, rugged, and (modularly) replaceable design.

A second implementation (FIG. 2) involves packing a catalyst 21 in powdered state into a hollow form, e.g., a cylinder 20 or the like, the object being that the reactant flow through the interstitial spaces in the cylinder and into the powder. This clearly provides a porous access to the catalyst, thus still allowing the flow of reactants. This configuration maximizes the surface area presented by the catalyst, but does not provide the same tight molecular binding/orientation as provided by the previous embodiment. The use of a conductive dopant may be necessary in this configuration, if the catalyst itself (e.g., titanium) is not a good electrical conductor. The actual chemical doping of the catalytic electrode can be accomplished during its manufacture, prior to its integration into the catalysis cell.

To this point the discussion has assumed a traditional view of catalysis as being a surface phenomenon, i.e., as occurring at an interface. These embodiments also apply where the catalysis occurs within a volume, e.g., the absorption of a gas or plasma by a latticed structure. In this case, diffusion of the reactants into the catalyst must proceed at a minimum rate for a threshold yield. Physical alignments (of a crystal structure, for example) or the application of pressure or voltage can be critical, because distortion of the catalyst structure may enhance the reaction rate enormously. A lattice can be disrupted by application of such a perturbation to cause a rupture in the otherwise regular crystal structure of the catalytic electrode. This type of distortion can propagate throughout the volume and enhance the diffusion and reaction rates of the process. The introduction of these forces leads to this type of desirable domain-cracking.

Whereas the previous embodiments were well-suited for high temperature environments and for either volume or surface-dominated processes, the present embodiment is designed for use in surface-dominated processes where there is no high temperature component. Indeed, the use of this embodiment may decrease the temperature of an existing high temperature mode by spreading the current over a larger area, while maintaining high electric potentials.

There are two classes of configurations, one based on foils, the second based on assemblies of thin tubes or cylinders or the like.

The advantage of the foil based configurations is that they are easily formed from available stock through elementary metal-forming processes. For example, rolls of titanium stock, 0.001–0.010 inch thick, can be readily formed into a cylindrical spiral 30 (see FIG. 3). The tightness of the spiral determines the amount of surface area available to the reactants. Similarly, the wave-like configuration 40 of FIG. 4 will also yield high surface area in a minimum volume. This configuration is also easily formed with conventional materials and standard metallurgical techniques.

Figure 5:
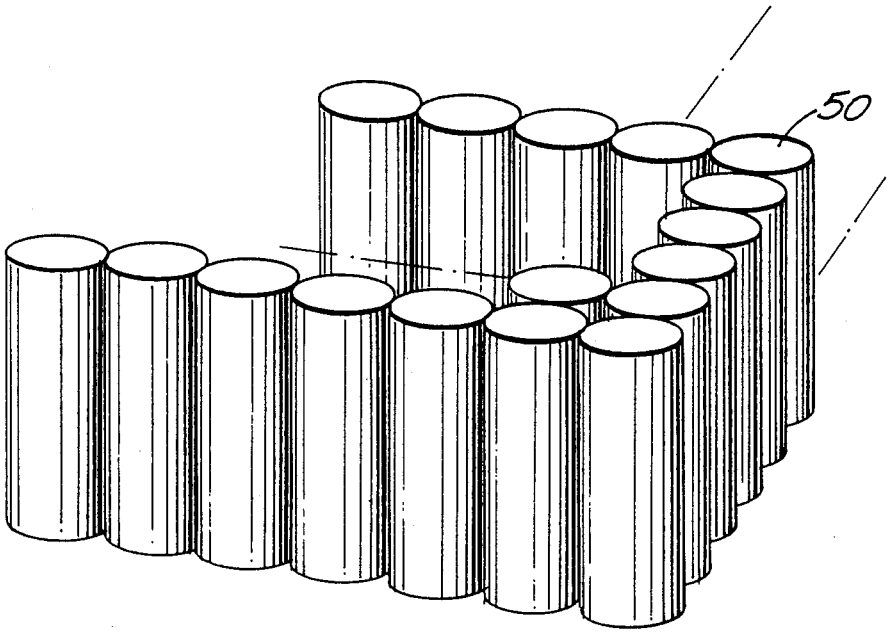

The second class of configurations is based on a modular array of tubular building blocks 50, whose surfaces may be rectangular or round or any convenient cross-section as shown FIG. 5. These structures may be solid or hollow which allows heat to be extracted or dissipated by passing a fluid through the center.

Figure 3:
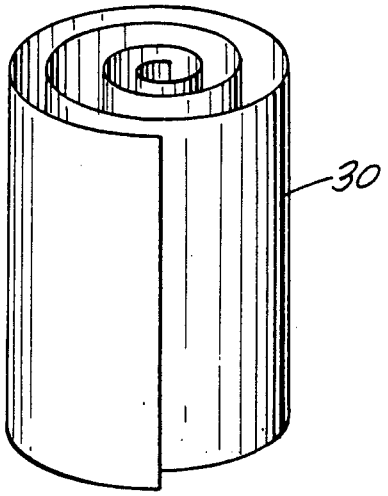
Figure 4:
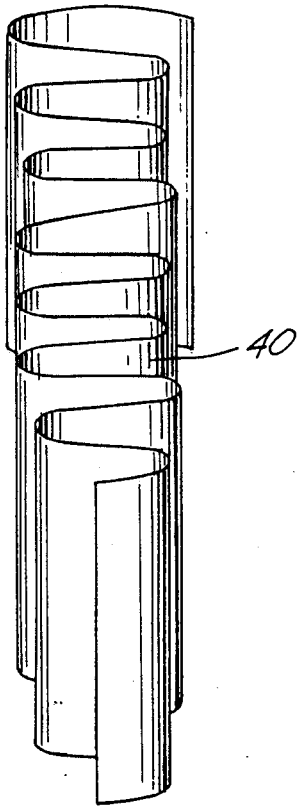

The structures of FIGS. 3 and 4 can also be used as modules in superstructures that follow the pattern of FIG. 5.

Compression can be delivered to the catalytic electrode via direct mechanical means or by coupling through a medium. The purpose of the compression is to exert a non-uniform stress on the micro-structure of the catalytic electrode thereby either breaking local bonds that inhibit the desired reaction, or to produce a local strain in the lattice that may favor a process which is otherwise sub-critical. A preferred means of compression is via application of hydraulic pressure directly on the catalytic electrodes. This method allows precise force to be applied to the catalytic electrode. Either of two configurations will suffice: (1) The catalytic electrode protrudes from the reactant solution and the compressive force is applied outside the solution. (2) The compression element is immersed in the reactant solution, and the compressive force is applied within the solution.

This method favors structures that can support the compression without significant mechanical deformation, e.g., the tube structure of FIG. 5 or the ceramic host of FIG. 1. Clearly, the latter can absorb far more compression without macroscopic deformation than the former. If properly designed, even the tube structures can be built to withstand pressures in excess of 100 atmospheres, as seen in honeycomb structures commonly used in aircraft components.

Figure 6:
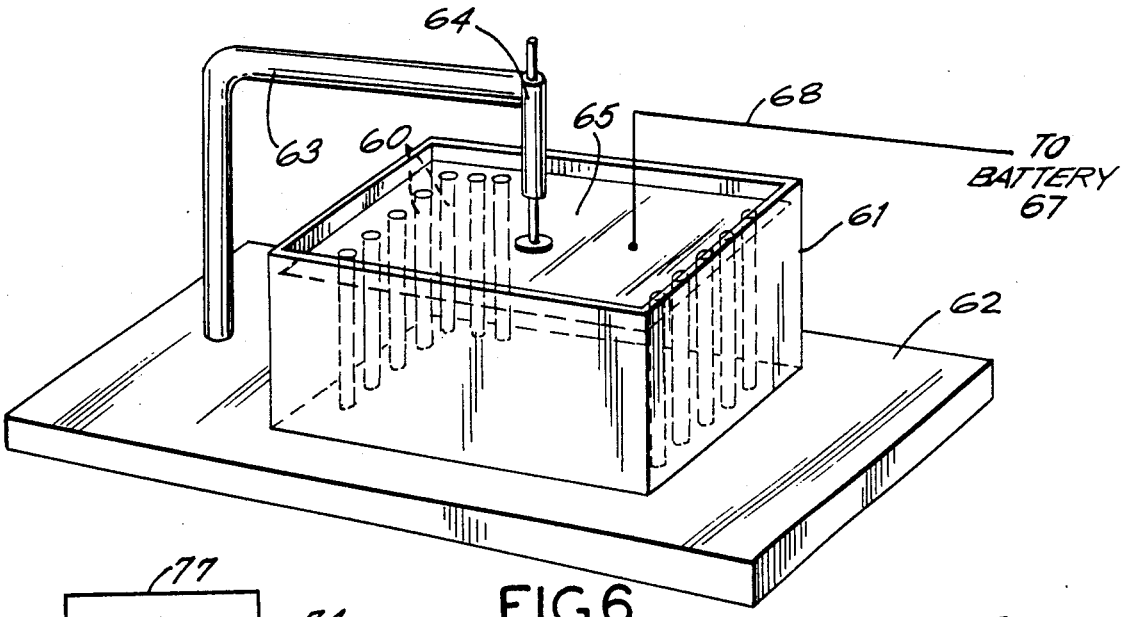
FIGS. 6–10 illustrate alternative embodiments for manipulating electrodes in accordance with the invention.

FIG. 6 shows a complete configuration utilizing hydraulic pressure to compress an array of catalytic electrode tubes shown seen in FIG. 5. A containment vessel 61 is positioned on a rigid base 62, with a rigid arm 63 which supports a hydraulic piston 64. The piston is attached to but electrically insulated from the conductive plate 65, through which pressure is applied to a catalytic electrode array 60. A conductor 68 is affixed to the plate 65 providing means of attachment to a power source 67.

Figure 7:
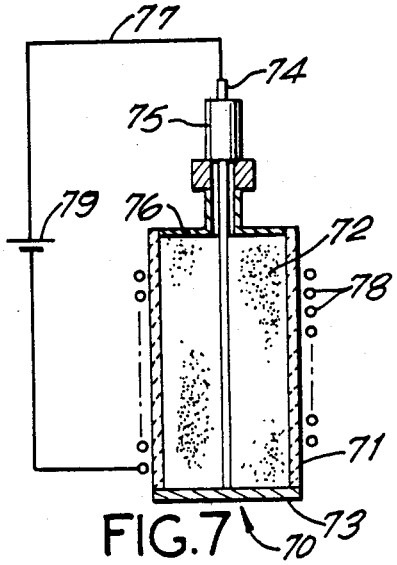

Another example is the powdered configuration in a hollow form, where a ram acting as a control rod can be used to apply pressure to the catalyst directly, thereby controlling the reaction rate. Far greater pressure can be applied in this case, perhaps as much as 1000 atmospheres for large-scale structures. FIG. 7 presents a simplified cut-away view of such a configuration. The electrode assembly 70, consisting of a ceramic cylinder 71, is filled with powdered catalytic material 72. A baseplate 73 is attached to a rod 74 which penetrates through the powdered material. The purpose of the rod is to provide a tension-affixment point for traveling plate 76 and held in position by hydraulic piston 75 at a predetermined pressure. The rod 74 via conductor 77 to power supply 79, which is also connected to second electrode 78.

The pressures of $10^6$ atmospheres and greater that are used for specialized processes, e.g., artificial diamonds, are not appropriate here because the region over which these high pressures can be applied must be small; the size of these regions is limited by the intrinsic material deformation properties.

Figure 8:
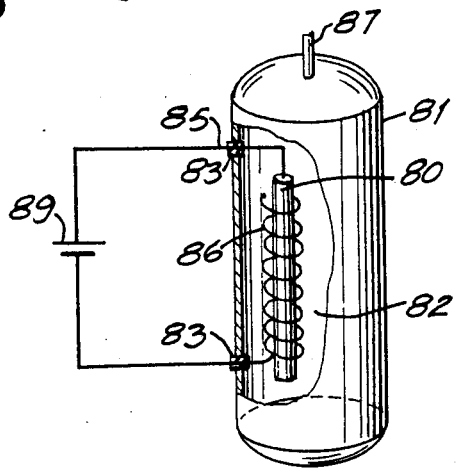

The reactant solution itself can be pressurized externally and the hydrostatic pressure employed to serve the compression function. This method can be used to a pressure of 100 atmospheres without serious difficulty. This is a particularly effective embodiment, since the reactant solution serves two purposes simultaneously, as shown in FIG. 8. The vessel in the form of a cylinder 81 containing a solution 82 is pressurized through inlet valve 87. Catalytic electrode 80 is suspended in the solution by means of conductor 85, which is surrounded by (but not touching) another electrode 86. The conductors are inserted through the wall of the pressure vessel via pressure seals 83 and connected to opposite poles of a battery or other power source 87.

Tension can be applied by fixing the ends of the catalytic electrode to plates or the like which can then be pulled apart and/or twisted with specified force or frequency. Tension and torque can be applied to specimen configurations that include both foils and assemblies of thin tubes or cylinders as discussed previously, as well as the common standard catalytic electrode configurations. For thin tubes, deformations of several minutes of arc (angular measure) in displacement of top and bottom could be carried out, deformations of 1 degree, even for the longest of tubes, appear to be the outer limit for this technique.

Figure 9:
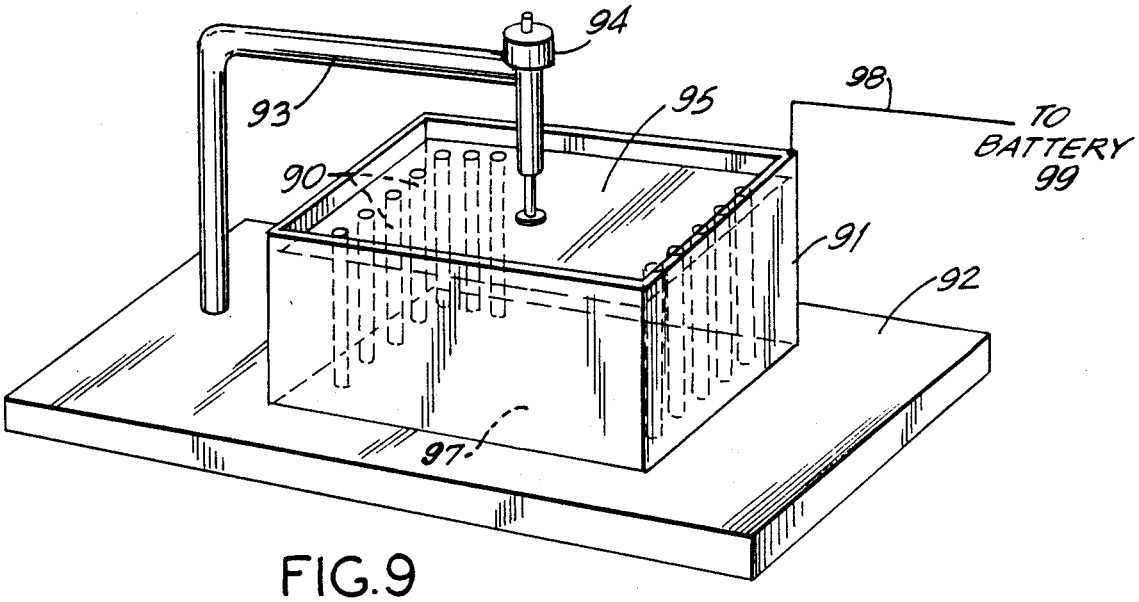

FIG. 9 shows a complete configuration utilizing hydraulic pressure to pull an array of catalytic electrode tubes 90 as originally seen in FIG. 5. The electrode tubes are rigidly fastened to top and bottom plates 95 and 97. A containment vessel 91 is positioned on a rigid base 92, with a rigid arm 93 which supports a hydraulic piston 94 whose force direction is up, away from the vessel. The piston is attached to but electrically insulated from the top plate 95, through which tension is applied to the catalytic electrode array 90. A conductor 98 is affixed to the plate 95 providing means of attachment to a power source 99. The non-catalytic electrode(s) are not shown.

Figure 10:
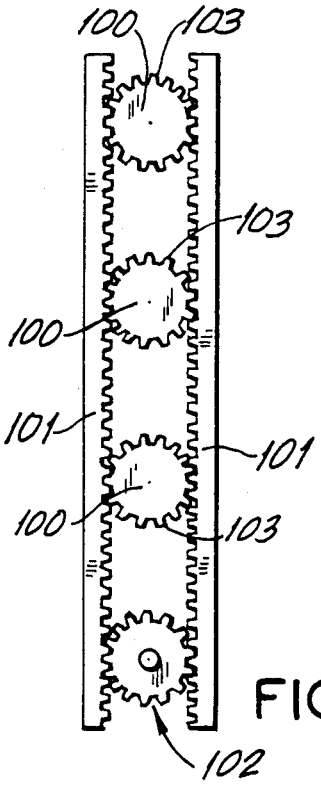

FIG. 10 shows a configuration for twisting the array of catalytic electrode tubes. The distinguishing characteristic for applying such a torque is that it must be applied to each element individually. Thus, the arrangement of FIG. 10 shows a top view of three elements 100 of an array, each of which is configured with an insulating pinion gear 103 rigidly affixed to the top of the tube. Rack gears 101 engage the pinion gears so that any translation of the rack provided by gear 102 which is driven by a motor (not shown) results in a specified angular displacement of all the tops of the tubes. The racks work in equal and opposite directions. Moreover they can be double-sided, thus providing motion to another set of pinions located on the opposite side of the first set. In this way a two-dimensional array of such tubes can be driven at specified twist angle.

The purpose of a shock wave in the catalytic electrode is to disturb any higher order alignments which may interfere with the catalytic process. Thus, the shorter the time scale over which the shock is delivered, the larger the instantaneous force imparted to the structure of the catalytic electrode.

Figure 11:
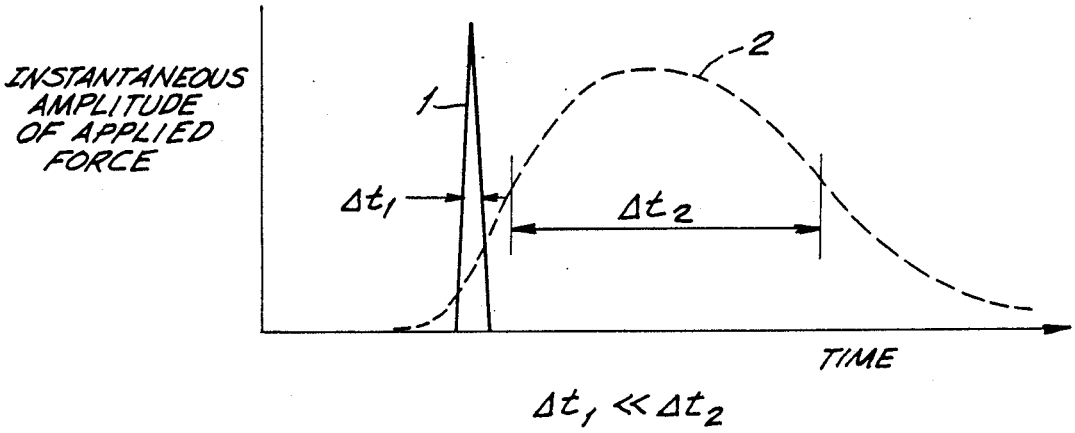
FIG. 11 is a graph showing effect of force on an electrodes.

The purpose of the shock (or any of the other time-varying techniques of dynamic manipulation) is to induce a wave or series of waves of adjustable amplitudes and frequencies that will break the large-scale domains into smaller scale regions. Thus, physical devices that can deliver sharp impulse functions as shown in FIG. 11 are to be preferred to those that operate in more limited frequency ranges. In most materials, the velocities (both shear and longitudinal) vary between $10^5$–$10^6$ cm/sec. The approach utilizes the differential velocity between and instantaneous amplitudes of the different frequency components so that opposite forces can be generated within small spatial scales. This small and local destructive interference within the catalytic electrode can be tailored to the desired spatial scale. It is noted that single frequencies are impractical for achieving disruptions on this spatial scale, since frequencies on the order of $10^{10}$ or $10^{11}$ cycles per second would be required. Thus, for spatial scales measured in angstroms or hundreds of angstroms and the aforementioned velocities, the preferred frequency is on the order of 50,000 Hz for a catalytic electrode of characteristic length 10 cm; at the same time, a nominal bandwidth of sufficient width must be maintained about that central frequency so that the interfrequency force differences result in local lattice deformation. The frequency scales inversely with the catalytic electrode size. Thus, a 100 cm long catalytic electrode would require a 5000 Hz minimum frequency. Much smaller frequencies result in uniform displacements of the catalytic electrode, and so there is no differential force.

To the extent that periodicities in the applied signal and reflections from the boundaries of the catalytic electrodes and their holding fixtures exist, resonances can be made to occur. These resonances result in tremendous local forces and displacements which may or may not be beneficial to the particular process. By varying the applied frequency spectrum and the duty cycle, the position and magnitude of this resonance can be changed. Thus, the resonance could be made to follow a pre-determined periodic path through the catalytic electrode.

Figure 12:
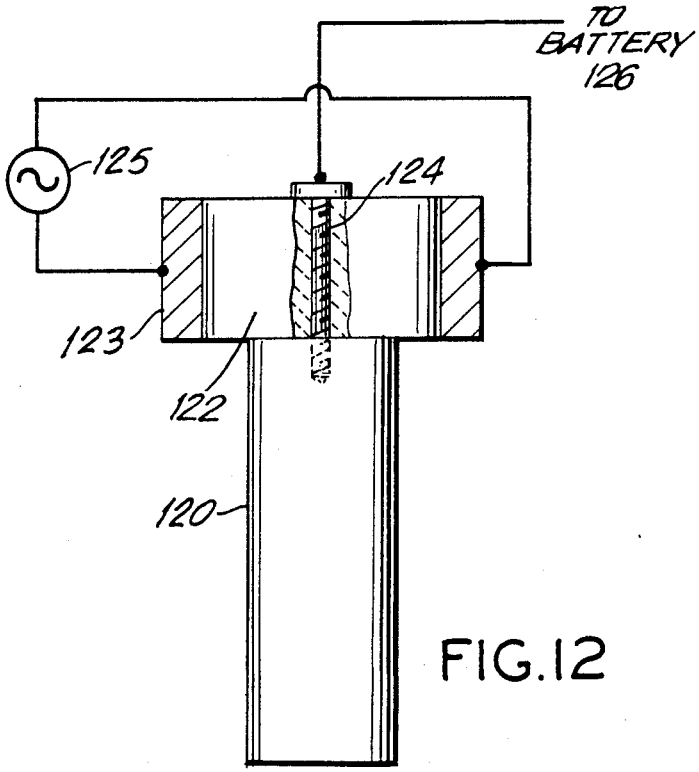
FIGS. 12–13 illustrate further embodiments for manipulating electrodes in accordance with the invention.

A mechanical impulse may be imparted by a device as simple as a pneumatic tool such as an air hammer, or as sophisticated as an external piezoelectric crystal electrically insulated from the catalytic electrode. Frequencies for the pneumatic approach might be as high as $10^4$ cycles per second, while the piezoelectric approach offers the possibility of megahertz excitations. FIG. 12 shows a simplified view of a catalytic electrode 120 as being driven by a piezoelectric transducer. The transducer consists of a ceramic body 122 and two conducting plates 123. The conducting plates are connected to a signal generator 125 and to the catalytic electrode by means of a screw 124. While this screw is shown as being the conductor leading to the battery 126, this connection is not necessary. The electrode of opposite polarity is not shown.

Shock can also be imparted via acoustic devices, but the coupling medium often required by such acoustic sources lengthens the time-scale over which the shock is applied. This increase in time results in a much smaller instantaneous magnitude for the applied force.

Acoustic methods generate waves in the catalytic electrode to break up the higher order alignments that may result in super-crystallite structures that reduce the efficiency of the catalytic process. What normally distinguishes acoustic methods from other more direct mechanical methods is the need for a medium to couple the transducer to the specimen. In particular, acoustic transducers may be attached to any of the heretofore mentioned embodiments both internal and external to the solution to effect this transfer of acoustic energy into the structure of the catalytic electrode.

Acoustic transducers are especially amenable to variable amplitude, frequency, and pulse shaping. Thus, the acoustic pulses can be tailored to the specific shape and configuration of the catalytic electrode. This approach can be used to exploit natural resonances of the electrode or its microstructures.

Figure 13:
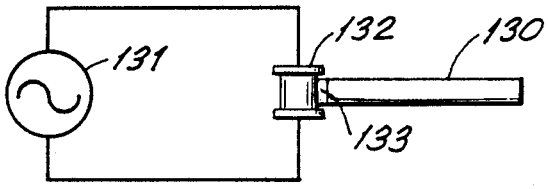

FIG. 13 shows an ultrasonic transducer 132 which is coupled to the catalytic electrode 130 be means of the coupling medium 133, typically a commercial gel made expressly for this purpose. The transducer is of a type similar to, for example, Picker type 595516D which can operate at frequencies as high as 2 MHz. The transducer is driven by a commercial signal generator 131, e.g., Wavetek or Hewlett Packard, whose output is typically routed to the transducer by means of a coaxial UHF cable.

Dislocations in local structure can be brought about by the application of intense radiation. This can be in the form of bombardment by x- and gamma rays, neutrons, or, in the case of very thin catalytic electrodes, electrons. The advantage for this type of approach is the continuous non-contact nature of the radiation. No local mechanical stress need be applied. Thus, the radiation method can be utilized with very thin-walled or otherwise physically delicate catalytic electrodes. A typical configuration would involve placing such a electrolytic cell near a gamma ray producer. Large installations could employ an onsite reactor to produce high doses of these radiations. Typical dose rates of 1 megarad-100 megarads can disrupt the local crystal structure, and lead to embrittlement and fatigue-like symptoms of the catalytic electrode.

Any of these methods can be applied simultaneously or in series with any of the other methods. Moreover, the frequency of application can also be varied at will. This multi-dimensional approach obviates the difficulties posed by the limits of any single method. For example, the combination of tension and torque may be made cyclic on timescales ranging from milliseconds to minutes. Piezoelectric approaches can be varied on timescales of microseconds.

Certain electrochemical processes may be inhibited by the formation of undesired products of reaction (e.g., gas bubbles) on the electrode surfaces, either on the catalytic electrode, or on the electrode of opposite polarity. If the electrode of opposite polarity is properly constructed, these same methods may be applied to promote the release of these undesired products. Thus, in the muon fusion paper of Jones et al., and in the Pons-Fleischmann cold fusion experiment, the build-up of oxygen on the anode could be avoided by these methods. The mechanism, however, is completely different from that describing the interaction of the catalytic electrode, since the accumulation of product on the anode is primarily a surface phenomenon.

It will be appreciated that the instant specification and claims are set forth by way of illustration and not limitation, and that various modifications and changes may be made without departing from the spirit and scope of the present invention.

What is claimed is:

1. An apparatus for a catalytic process, comprising: at least one electrode composed of catalytic material, means for applying an electric current to the at least one electrode and means for mechanically manipulating the at least one electrode to increase the operating efficiency thereof during application of the electric current.

2. The apparatus according to claim 1, wherein the means for manipulating comprises means for applying a static force.

3. The apparatus according to claim 1, wherein the means for manipulating comprises means for applying a dynamic time-varying force.

4. The apparatus according to claim 2 or 3, wherein the means for applying a force comprises means for compressing the at least one electrode.

5. The apparatus according to claim 2 or 3, wherein the means for applying a force comprises means for torquing that at least one electrode.

6. The apparatus according to claim 2 or 3, wherein the means for applying a force comprises means for applying tension to the at least one electrode.

7. The apparatus according to claim 2 or 3, wherein the means for applying a force comprises means for applying an acoustic ware to the at least one electrode.

8. The apparatus according to claim 2 or 3, wherein the means for applying a force comprises means for applying a shock to the at least one electrode.

9. The apparatus according to claim 1, wherein the at least one electrode comprises a sheet with a spiral crosssection.

10. The apparatus according to claim 1, wherein the at least one electrode comprises a sheet with a sinusoidal crosssection.

11. The apparatus according to claim 1, wherein the at least one electrode comprises a plurality of parallel tubular members.

12. The apparatus according to claim 1, wherein the at least one electrode comprises a ceramic member with catalyst particles embedded therein.

13. The apparatus according to claim 1, wherein the at least one electrode comprises a ceramic tube filled with catalyst powder.

14. A catalytic process, comprising: providing at least one electrode composed of catalytic material, applying an electric current to the at least one electrode and mechanically manipulating the at least one electrode to increase the operating efficiency thereof during application of the electric current.

15. The process according to claim 14, wherein the manipulating comprises applying a static force.

16. The process according to claim 14, wherein the manipulating comprises applying a dynamic time-varying force.

17. The process according to claim 15 or 16, wherein applying a force comprises compressing the at least one electrode.

18. The process according to claim 15 or 16, wherein applying a force comprises torquing the at least one electrode.

19. The process according to claim 15 or 16, wherein applying a force comprises applying tension to the at least one electrode.

20. The process according to claim 15 or 16, wherein applying a forcee comprises applying an acoustic wave to the at least one electrode.

21. The process according to claim 15 or 16, wherein applying a force comprises applying a shock wave to the at least one electrode.

22. The process according to claim 14, wherein providing at least one electrode comprises providing a sheet with a spiral cross-section.

23. The process according to claim 22, wherein providing at least one electrode comprises a sheet with a sinusoidal cross-section.

24. The process according to claim 22, wherein providing at least one electrode comprises a plurality of parallel tubular members.

25. The process according to claim 22, wherein providing at least one electrode comprises a ceramic member with catalyst particles embedded therein.

26. The process according to claim 22, wherein providing at least one electrode comprises a ceramic tube filled with catalyst powder.

* * * * *